US010226879B2

(12) United States Patent
Durham

(10) Patent No.: US 10,226,879 B2
(45) Date of Patent: Mar. 12, 2019

(54) CUTTING AND SEALING APPARATUSES AND METHODS

(75) Inventor: Jeffery S. Durham, Kaysville, UT (US)

(73) Assignee: American Crafts, L.C., Lindon, UT (US)

( * ) Notice: Subject to any disclaimer, the term of this patent is extended or adjusted under 35 U.S.C. 154(b) by 848 days.

(21) Appl. No.: 13/479,061

(22) Filed: May 23, 2012

(65) Prior Publication Data

US 2013/0014622 A1 Jan. 17, 2013

Related U.S. Application Data

(60) Provisional application No. 61/506,940, filed on Jul. 12, 2011.

(51) Int. Cl.

| | |
|---|---|
| ***B26D 7/10*** | (2006.01) |
| ***B26D 1/547*** | (2006.01) |
| ***B26F 3/12*** | (2006.01) |
| ***D06H 7/22*** | (2006.01) |
| *B26D 1/30* | (2006.01) |

(52) U.S. Cl.

CPC ..... *B26F 3/12* (2013.01); *D06H 7/221* (2013.01); *B26D 1/305* (2013.01); *B26D 7/10* (2013.01); *Y10T 83/0405* (2015.04); *Y10T 83/0414* (2015.04); *Y10T 83/293* (2015.04); *Y10T 83/8821* (2015.04); *Y10T 83/8878* (2015.04)

(58) Field of Classification Search

CPC . B26D 7/10; B26D 7/01; B26D 7/015; B26D 7/02; B26F 3/12; D06H 7/221; Y10T 83/8821; Y10T 83/8878; Y10T 83/0405; Y10T 83/0414; Y10T 83/293

USPC ..... 30/278, 134, 272.1, 273, 305, 315, 116; 83/171

See application file for complete search history.

(56) References Cited

U.S. PATENT DOCUMENTS

| | | | | | |
|---|---|---|---|---|---|
| 3,323,208 | A | * | 6/1967 | Hurley, Jr. | 606/120 |
| 3,419,201 | A | * | 12/1968 | Brandon | A47K 10/32 225/93 |
| 3,883,953 | A | * | 5/1975 | Saullo et al. | 30/304 |
| 4,133,109 | A | * | 1/1979 | Dow | 30/279.2 |
| 4,417,495 | A | * | 11/1983 | Gordon | B26D 7/14 225/43 |
| 4,513,501 | A | * | 4/1985 | Lee | 30/115 |
| 4,716,886 | A | * | 1/1988 | Schulman et al. | 606/120 |
| 4,938,215 | A | * | 7/1990 | Schulman et al. | 606/120 |
| 5,005,289 | A | * | 4/1991 | Vogele | 30/140 |
| 5,054,699 | A | * | 10/1991 | DeJaynes | 241/101.2 |
| 5,400,452 | A | * | 3/1995 | Goldstein | 7/135 |

* cited by examiner

*Primary Examiner* — Omar Flores Sanchez

(74) *Attorney, Agent, or Firm* — Durham Jones & Pinegar, P.C.

(57) ABSTRACT

A cutting apparatus configured to hold an elongate element, such as a ribbon, in a desired orientation as the elongate element is cut into two sections. A cutting element of such a cutting apparatus may be confined to a single orientation relative to that of the elongate element, reducing or eliminating the likelihood of misalignment between the cutting element and the elongate element immediately before the elongate element is cut. In some embodiments, the cutting apparatus, or even its cutting element, may be configured to seal the newly cut ends of the elongate element. Methods for cutting and or sealing elongate elements, such as ribbons, are also disclosed.

20 Claims, 3 Drawing Sheets

CUTTING AND SEALING APPARATUSES AND METHODS

CROSS-REFERENCE TO RELATED APPLICATIONS

This application is a non-provisional of U.S. Provisional Patent Application No. 61/506,940 titled "Portable Cutting Apparatus," filed Jul. 12, 2011, (the "'940 Application"). A claim for the benefit of priority to the '940 Application is hereby made pursuant to 35 U.S.C. § 119(e). The entire disclosure of the foregoing application is, by this reference, hereby incorporated herein.

TECHNICAL FIELD

This disclosure relates generally to apparatuses for cutting elongate elements, such as ribbons, strings, cords and the like, and for sealing the cut ends of the elongate elements. More specifically, this disclosure relates to hot wire apparatus for forming clean cuts through elongate elements while sealing the cut ends of the elongate elements, and to cutting and sealing methods.

BACKGROUND OF RELATED ART

Conventionally, scissors have been used to cut ribbons and other elongate elements. When scissors are used to cut a ribbon, the individual who is cutting the ribbon holds it in one hand while using the scissors with his or her other hand. Oftentimes, manual ribbon cutting results in a crooked cut, a cut having an undesirable angle, or both. Thus, the ribbon may be cut repeatedly until an edge that meets the individual's expectations has been formed, or until the individual gives up and accepts an edge with one or more undesirable characteristics.

Even though many individuals are adept at using scissors to cut ribbons and other elongate elements, the use of scissors and other conventional cutting apparatuses does not prevent fraying of the cut edges.

SUMMARY

In various embodiments, a cutting apparatus may be configured to hold an elongate element, such as a ribbon, in a desired orientation as the elongate element is cut into two sections. A cutting element of such a cutting apparatus may be confined to a single orientation relative to that of the elongate element, reducing or eliminating the likelihood of misalignment between the cutting element and the elongate element immediately before the elongate element is cut. In some embodiments, the cutting apparatus, or even its cutting element, may be configured to seal the newly cut ends of the elongate element.

In a specific embodiment, the cutting apparatus includes a top and a base that are configured to be assembled with the elongate element positioned therebetween, and in a manner that holds the elongate element in a desired orientation while the cutting element of the cutting apparatus engages and cuts the elongate element. One or both of the top and the base may include features that retain the elongate element in its desired orientation (to cut the elongate element precisely as desired) and in a position that enables precise and accurate cutting of the elongate element.

The cutting element of the cutting apparatus may comprise an elongate element that is configured to be forced through an elongate element while the elongate element is held in position by the cutting apparatus. In some embodiments, the cutting element may comprise a so-called "hot wire," which comprises an elongate electrically resistive element, or wire, of an electrical circuit that may be heated to a sufficient temperature to simultaneously cut through and seal the newly cut edges of the elongate element.

In addition to apparatuses for cutting through elongate elements, methods for cutting elongate elements (e.g., ribbons, etc.) are disclosed. One embodiment of such a method includes orienting an elongate element relative to a cutting element. With movement of the cutting element confined in a manner that dictates where the cutting element may engage the elongate element (e.g., by a cutting apparatus that simultaneously holds and cuts the elongate element, etc.), the cutting element may be forced through and, thus, cut the elongate element. In some embodiments the edges of the elongate element may be sealed as they are cut. Once the elongate element has been cut, it may be released and used in a desired manner.

Other aspects, as well as features and advantages of various aspects, of the present invention will become apparent to those of ordinary skill in the art through consideration of the ensuing description, the accompanying drawings and the appended claims.

DETAILED DESCRIPTION

Figure 1:
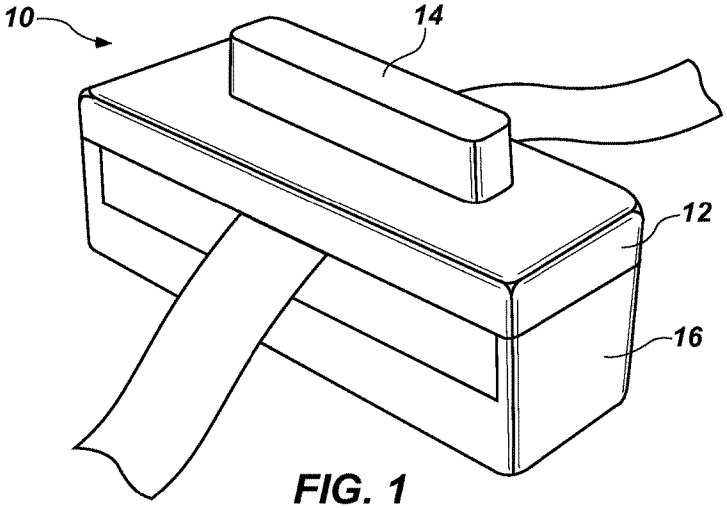
FIG. 1 is a perspective view of an embodiment of cutting apparatus.
Figure 2:
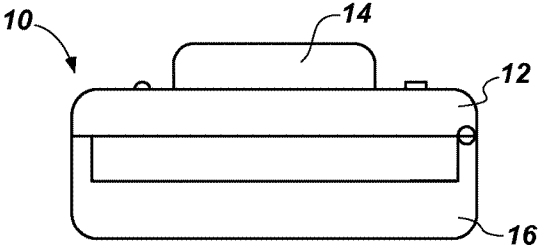
FIG. 2 is side view of the embodiment of cutting apparatus depicted by FIG. 1.

FIG. 1 illustrates an embodiment of a cutting apparatus 10 that incorporates teachings of this disclosure. The illustrated cutting apparatus 10 includes a top 12 and a base 16, which are configured to be at least partially assembled with and disassembled from one another. More specifically, the top 12 may be configured to be positioned over and assembled with the base 16 to define a closed arrangement between the top 12 and the base 16. In addition, the top 12 may be configured to be removed from or spaced apart from the base 16 to provide an open arrangement of the top 12 and the base 16. In some embodiments, a hinge 18 (FIGS. 3 and 7) may secure corresponding edges of the top 12 and the base 16 to one another to facilitate movement of the top 12 between the closed position over the base 16 and the open position relative to the base 16.

With reference to FIGS. 2 through 6, an embodiment of the top 12 of a cutting apparatus 10 is described in further detail. The top 12 may include an upper surface 20 and an opposite engagement portion 21. The upper surface 20 may define at least a portion of an upper surface of the cutting apparatus 10, while the engagement portion 21, and a retention surface 30 thereof, may be configured to face the base 16 of the cutting apparatus 10 when the top 12 is placed over the base 16 in the closed arrangement.

Figure 5:
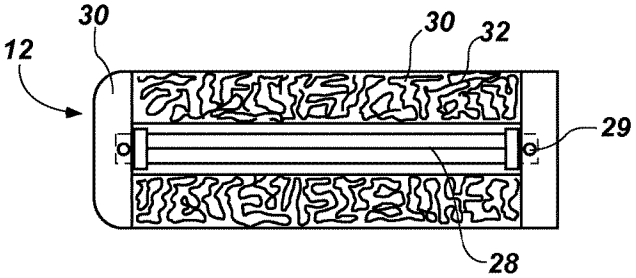
FIG. 5 is a bottom view of the top shown in FIG. 3.

The engagement portion 21 of the top 12 may define a recess 22. As depicted in FIG. 5, the recess 22 may be elongated in configuration and be arranged centrally relative to the retention surface 30 into which the recess 22 extends (e.g., between elongated, spaced apart sections of the retention surface 30, etc.). An aperture 15 may extend between the recess 22 and the upper surface 20 of the top 12. Together, the aperture 15 and the recess 22 may accommodate certain other components of the top 12.

Among other components, the top 12 may include a button 14 with an external portion 14E and an internal portion 141. The external portion 14E of the button 14 may extend through the aperture 15 and protrude from the outer surface 20 of the top 12, where the external portion 14E of the button 14 may be accessed and depressed when use of the cutting apparatus 10 is desired.

The internal portion 141 of the button 14 may be located within the recess 22. As depicted, the internal portion 141 may include a pair of spaced apart arms 27 that extend generally away from the upper surface 20 of the top 12. A wire 28 may extend from one arm 27 to the other, and be positioned at an elevation that causes the wire 28 to remain within the recess 22 when the button 14 is in its non-operational original position, but enables the wire 28 to be moved downwardly out of the recess 22 as the external portion 14E of the button 14 and, thus, the button 14 is depressed, or placed in an operational position.

The top 12 may also include means for resiliently moving the button 14 back to its original position once its external portion 14E is released. In a specific embodiment, shown in FIG. 4, one or more springs 29 may be associated with the internal portion 141 of the button 14 in a manner that urges the button 14 toward its original position.

Figure 3:
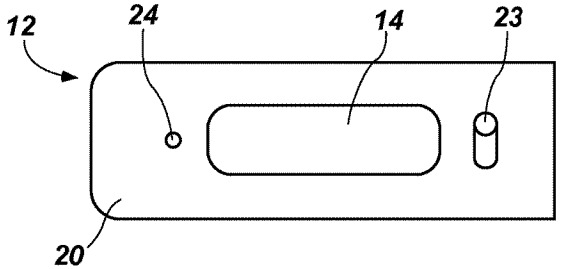
FIG. 3 is a top view of a top of the embodiment of cutting apparatus depicted by FIG. 1.
Figure 4:
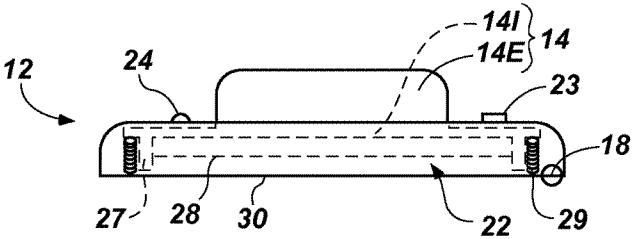
FIG. 4 is a side view of the top shown in FIG. 3.
Figure 8:
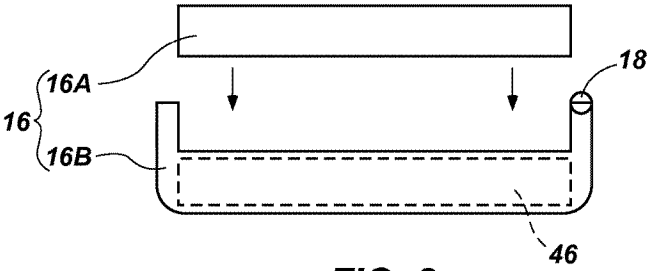
FIG. 8 is a side view of the base shown in FIG. 7.

As FIGS. 3 and 4 illustrate, the top 12 may also include other features, such as the depicted switch 23 (e.g., a two position sliding switch, etc.) and indicator light 24 (e.g., a light-emitting diode lamp, etc.), which are associated with an electrical circuit of which the wire 28 and a power source 46 (FIG. 8) is also a part. The wire 28 may comprise an electrically conductive material with sufficient resistance to heat up to a desired temperature as the switch 23 is placed in a position that completes the electrical circuit and the power source 46 applies a current to the wire 28.

In some embodiments, the top 12 of a cutting apparatus 10 may also include a safety mechanism. In some embodiments, a safety mechanism may prevent depression of the button 14 if the top 12 and the base 16 are not in the closed arrangement, but enable depression of the button 14 if the top 12 and the base 16 are in the closed arrangement. In addition, or alternatively, a safety mechanism may be configured to enable operation of the heating element only when the top 12 and the base 16 are in the closed arrangement.

Turning now to FIGS. 7 through 10, an embodiment of the base 16 of a cutting apparatus 10 is illustrated.

Figure 6:
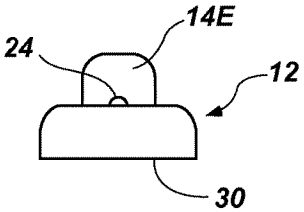
FIG. 6 is an end view of the top shown in FIG. 3.
Figure 7B:
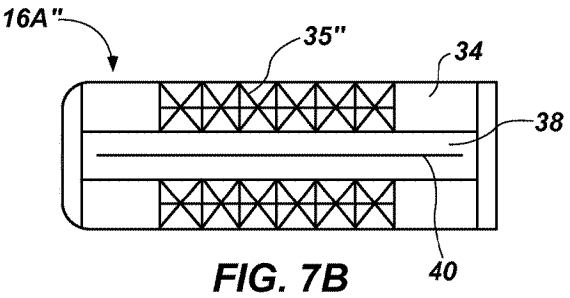
FIG. 7B is another variation of the upper surface of the base shown in FIG. 7.
Figure 7:
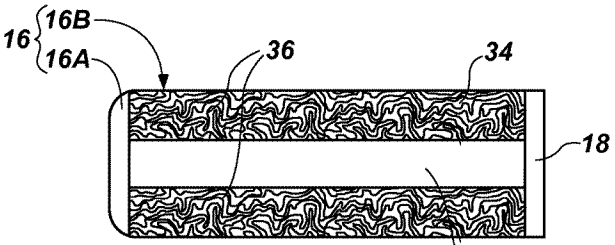
FIG. 7 is a top view of a base of the embodiment of cutting apparatus depicted by FIG. 1.

As shown in FIG. 7, the base 16 includes a support surface 34 against which the retention surface 30 of the top 12 (FIG. 6) is configured to be positioned. At least a portion of the support surface 34 may have a contour that complements a contour of a corresponding portion of the retention surface 30 of the top 12, which may enable these portions to contact each other when the top 12 and the base 16 are placed in the closed arrangement. In the depicted embodiment, the support surface 34 of the base 16 and the retention surface 30 of the top 12 are both flat.

With continued reference to FIG. 7 and returned reference to FIG. 6, one or both of the retention surface 30 of the top 12 and the support surface 34 of the base 16 may be configured to hold an elongate element in place while the top 12 and the base 16 are in the closed arrangement with the elongate element positioned between the retention surface 30 and the support surface 34, and as a downward force on (i.e., depression of) the button 14 (see, e.g., FIG. 4) forces the wire 28 (see, e.g., FIG. 4) against the elongate element. In some embodiments, one or both of the retention surface 30 and the support surface 34 may comprise (e.g., be coated with, be formed from, etc.) an engagement material 32 and 36, respectively, that holds the elongate element in place. Such an engagement material 32, 36 may be tacky, compliant or have another property that enables it to engage the elongate material. In a specific embodiment, one or both of the retention surface 30 and the support surface 34 may comprise silicone. In addition, or as an alternative, one or both of the retention surface 30 and the support surface 34 may include a texture 33 and 37, respectively, that holds the elongate element in place.

Figure 7A:
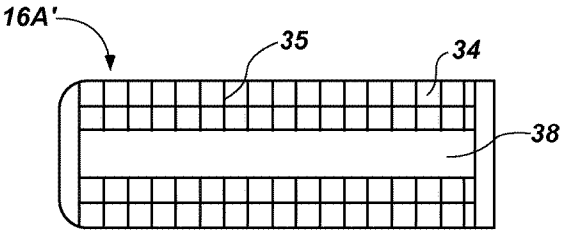
FIG. 7A is a variation of an upper surface of the base shown in FIG. 7.

In some embodiments, such as those illustrated by FIGS. 7A and 7B, the support surface 34 of an engagement portion 16A of the base 16 may include alignment features 35, 35", which may facilitate placement of an elongate element on the support surface 34 and, thus, its alignment with the wire 28 (FIG. 4). In various embodiments, the alignment features 35, 35" may include horizontal elements and vertical elements. The alignment features 35" may also include diagonal elements.

Again referring to FIG. 7, in addition to the support surface 34, the engagment portion 16A of the base 16 includes an elongated receptacle 38 recessed in a central region of the support surface 34 (e.g., between spaced apart elongated sections of the support surface 34, etc.). The receptacle 38 may be configured to receive and accommodate the wire 28 (FIG. 4) and the arms 27 of the internal portion 141 of the button 14 (FIG. 4) (or at least the lowermost portions thereof) when the button 14 is depressed. In addition, as depicted by FIG. 7B, an indicator 40, such as the depicted line, may be provided in the bottom of the receptacle 38 to show where the wire 28 will intersect an elongate element positioned over the support surface 34.

Figure 10:
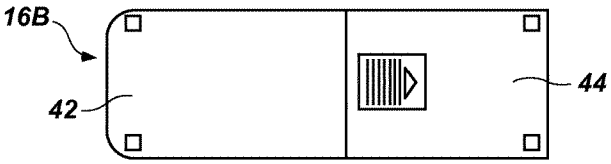
FIG. 10 is a bottom view of the base shown in FIG. 7.
Figure 9:
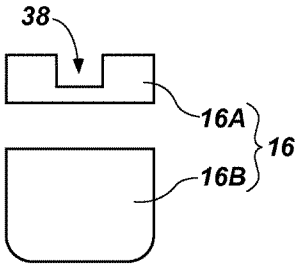
FIG. 9 is an end view of the base shown in FIG. 7.

The base 16 may also define a receptacle 45 for a power supply 46 (e.g., four AA batteries, etc.). In the embodiment depicted by FIGS. 7 through 9, the base 16 includes an engagement portion 16A and a lower portion 16B that are ordinarily assembled with one another (e.g., while the cutting apparatus 10 is being used, during storage of the cutting apparatus 10, etc.), but may be disassembled from one another to provide access to the receptacle 45, such as when access to the power supply 46 is desired (e.g., for replacement, etc.). Alternatively, as illustrated by FIG. 10, access to the receptacle 45 within the base 16 may be obtained through an access panel 44 (e.g., a sliding access panel, another type of battery cover, etc.) at the bottom surface 42 of the lower portion 16B of the base 16.

Various embodiments of methods for using the cutting apparatus 10 are also disclosed. In FIGS. 11 through 14, an embodiment of a method for forming a substantially linear cut through an elongate element 50 is depicted. FIGS. 15 through 18 illustrated an embodiment of a technique for forming a V-shaped cut through an elongate element 50'.

Figure 11:
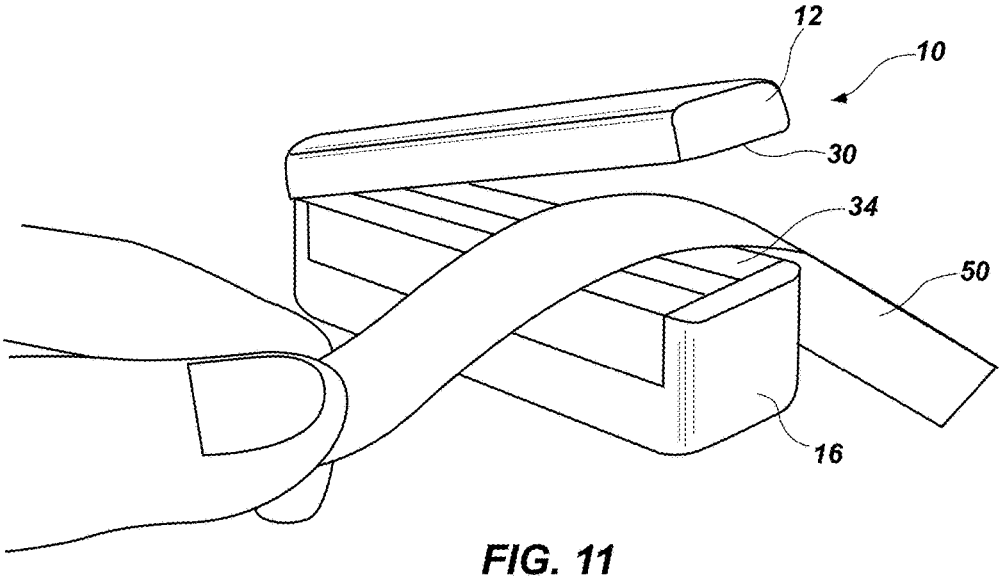
FIG. 11 is a perspective view of an embodiment of cutting apparatus, showing the cutting apparatus in an open orientation, with an elongate element disposed between the top and the base of the cutting apparatus.

As shown in FIG. 11, the top 12 of a cutting apparatus 10 may be at least partially spaced apart from the base 16 of the cutting apparatus 10 to expose a support surface 34 of the base 16. An elongate element 50 that is to be cut, such as the depicted ribbon, may be placed on and supported by the support surface 34. In some embodiments, one or more alignment features 35, 35' (FIGS. 7A and 7B, respectively) and/or another indicator 40 (FIG. 7B) may be used to guide placement of the elongate element 50 on the support surface 34.

With the elongate element 50 positioned as desired on the support surface 34, the top 12 of the cutting apparatus 10 may be positioned against the base 16, as shown in FIG. 1. In this closed arrangement, the retention surface 30 (FIG. 11) of the top 12 and the support surface 34 (FIG. 11) of the base 16 may hold the elongate element 50 in place.

The wire 28 (FIG. 4) may be heated as power is supplied to the wire 28. In the illustrated embodiment, power may be supplied to the wire 28 by moving the switch 23 to an "on" position. Once the wire 28 has heated to a sufficient temperature (which may occur within a matter of seconds (e.g., about five seconds or less, etc.) of supplying power to the wire 28), it may be used to cut the elongate element 50 and, when the elongate element 50 includes a material that may be seared or melted, seal the cut ends 52A and 52B (FIG. 13) of the elongate element 50.

Figure 12:
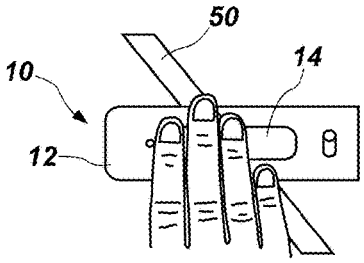
FIG. 12 illustrates depression of a button of the cutting apparatus shown in FIG. 11 to cut the elongate element.

As depicted by FIG. 12, slight depression of the button 14 in the top of the cutting apparatus 10 may force the top 12 against the base 16 (FIG. 11) and, thus, hold the elongate element 50 in place between the top 12 and the base 16. Further depression of the button 14 may bring the heated wire 28 (FIG. 4) into contact with the elongate element 50. As disclosed previously herein with reference to FIG. 7, such further depression of the button 14 may cause the wire 28 to move from a first position within a recess 22 in the top 12 of the cutting apparatus 10, or a location above (or on a first side of) the elongate element 50, to a second position within a receptacle 38 (FIGS 7 and 13) in the engagement portion 16A (FIGS. 7-7B) of the base 16 of the cutting apparatus 10, or a location beneath (or on a second side of) the elongate element 50. As the heated wire 28 contacts and is forced through a portion of the elongate element 50 that extends over the receptacle 38 in the base 16, the heated wire 28 cuts and, in some embodiments, seals the newly cut ends 52A and 52B (FIG. 13) of the elongate element 50.

Figure 13:
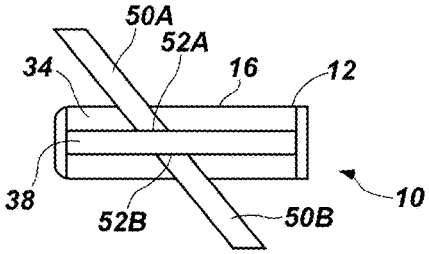
FIG. 13 shows the cutting apparatus in an open orientation, with the elongate element separated into two pieces, each having a linear cut end.

Once the elongate element 50 has been cut, the button 14 may be released, enabling the button 14 and the wire 28 to return to their original positions. As illustrated by FIG. 13, the top 12 may then be at least partially removed from the base 16 of the cutting apparatus 10, and the cut sections 50A and 50B of the elongate element 50 may be removed from the support surface 34 of the base 16.

Figure 14:
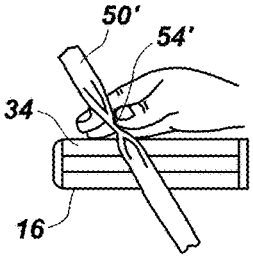
FIGS. 14 through 17 illustrate another embodiment of a method for cutting an elongate element, with the cut ends of the elongate element having V shapes.
Figure 15:
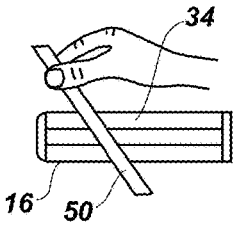
Figure 16:
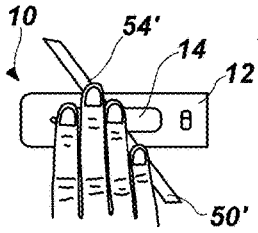
Figure 17:
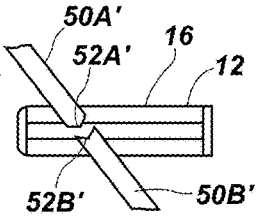

In a variation of the process depicted by FIGS. 11 through 13, FIGS. 14 through 17 illustrate a process in which a V-shaped cut may be formed in an elongate element 50'. As illustrated by FIG. 14, a portion 54' of the elongate element 50' may be folded along its length, then positioned somewhat diagonally relative to the support surface 34 of the base 16 of a cutting apparatus 10. While that portion 54' of the elongate element 50' remains folded, a top 12 of the cutting apparatus 10 may be positioned against the base 16, as shown in FIG. 15, holding the elongate element 50' in place and maintaining its folded orientation. With the wire 28 (FIG. 4) heated to a sufficient temperature, an individual may depress the button 14 in the top 12 of the cutting apparatus 10, as shown in FIG. 16, forcing the hot wire 28 through and cutting (and, in some embodiments, sealing) the folded portion 54' of the elongate element 50'. Once the elongate element 50' has been cut, the button 14 may be released and, along with the wire 28, allowed to return to its original position. Additionally, as shown in FIG. 17, the top 12 may be at least partially removed from the base 16 to enable removal of the cut sections 50A' and 50B' from the cutting apparatus 10. As the cut sections 50A' and 50B' are unfolded at their respective cut ends 52A' and 52B', the V shapes of the cut ends 52A' and 52B' are revealed.

By holding the elongate element in a desired orientation while confining movement of the wire 28 (or any other embodiment of cutting element), the cutting apparatus 10 may be used to cut an elongate element 50 without repeated effort. In addition, the use of a heated wire 28 to cut through an elongate element 50 may seal the newly cut edges 52, which may prevent fraying of the edges 52.

The disclosed embodiments should not be deemed to limit the scope of any of the claims that follow. The scope of each claim should be limited merely by its plain language, and should be deemed to include the full complement of available equivalents.

What is claimed:

1. A portable ribbon cutting apparatus, comprising:

a base member including:

a support surface including flat, spaced apart sections located in the same plane as one another, the support surface also comprising an engagement material, the support surface capable of supporting and engaging a ribbon placed transversely thereacross in any of a plurality of orientations, the engagement material of the support surface capable of engaging the ribbon to hold the ribbon in place across a receptacle between the flat, spaced apart sections of the support surface;

a top member capable of assembly with the base member, the top member including:

a retention surface comprising an engagement material, the retention surface positionable against the support surface of the base member, the retention surface being flat with the engagement material of the retention surface capable of engaging a ribbon transversely disposed across the support surface and of securely holding the ribbon in place between the support surface and the retention surface and across the receptacle of the base member;

at least one cutting element capable of moving beyond the retention surface and capable of being received by the receptacle of the base member, to a location beneath the support surface and between the flat, spaced apart sections of the support surface when the retention surface of the top member is positioned against the support surface of the base member.

2. The portable ribbon cutting apparatus of claim 1, further comprising:

a hinge securing an end of the base member to an end of the top member, the hinge, the base member and the top member assembled to align the top member with the base member when the retention surface of the top member is positioned against the support surface of the base member.

3. The portable ribbon cutting apparatus of claim 1, wherein the receptacle of the base member is elongate.

4. The portable ribbon cutting apparatus of claim 3, wherein the at least one cutting element is elongate.

5. The portable ribbon cutting apparatus of claim 1, wherein the at least one cutting element of the top member comprises a wire.

6. The portable ribbon cutting apparatus of claim 5, wherein the wire is capable of being heated.

7. The portable ribbon cutting apparatus of claim 6, wherein the wire is capable of being heated only when the retention surface of the top member is positioned against the support surface of the base member.

8. The portable ribbon cutting apparatus of claim 1, further comprising:

a button associated with the top member, the button being capable of causing the cutting element to be moved beyond the retention surface of the top member and into the receptacle of the base member after the retention surface of the top member has been positioned against the support surface of the base member.

9. A portable ribbon cutting apparatus, comprising:

a base member including:

a support surface including flat, spaced apart sections that are located in the same plane as one another, the support surface capable of holding a ribbon in place;

an engagement material on the support surface; and a receptacle between the flat, spaced apart sections of the support surface, the support surface capable of supporting the ribbon transversely disposed across the flat, spaced apart sections and the receptacle in any of a plurality of orientations;

a top member capable of assembly with the base member, the top member including:

a retention surface positionable against the support surface, the retention surface being planar;

an engagement material on the retention surface, the engagement material on the retention surface and the engagement material on the support surface of the base member being capable of holding the ribbon in place between the retention surface and the support surface and across the receptacle upon forcing the retention surface against the support surface without damaging the ribbon;

at least one wire movable beyond the retention surface and capable of being received by the receptacle of the base member, to a location beneath the support surface and between the flat, spaced apart sections of the support surface of the base member, when the retention surface of the top member is positioned against the support surface of the base member in a closed arrangement, the support surface of the base member and the retention surface of the top member capable of placement in the closed arrangement and to hold the ribbon in place across the receptacle before a downward force is applied by the wire to the ribbon.

10. The portable ribbon cutting apparatus of claim 9, further comprising:

a hinge securing an end of the base member to an end of the top member, the hinge, the base member and the top member assembled to align the top member with the base member when the retention surface of the top member is positioned against the support surface of the base member.

11. The portable ribbon cutting apparatus of claim 1, wherein the receptacle of the base member is elongate.

12. The portable ribbon cutting apparatus of claim 9, wherein the wire is capable of being heated.

13. The portable ribbon cutting apparatus of claim 12, wherein the wire is capable of being heated only when the retention surface of the top member is positioned against the support surface of the base member.

14. The portable ribbon cutting apparatus of claim 10, further comprising:

a button associated with the top member, the button capable of causing the cutting element to be moved beyond the retention surface of the top member and into the receptacle of the base member.

15. A portable ribbon cutting apparatus, comprising:

a base member including:

a support surface including flat, spaced apart sections that are located in the same plane, the support surface including an engagement material capable of engaging a ribbon transversely disposed thereacross in any of a plurality of orientations without altering an appearance of a surface of the ribbon; and a receptacle between the flat, spaced apart sections of the support surface, beneath the support surface;

a top member capable of assembly with the base member, the top member including:

a retention surface positionable flat against the support surface in a closed configuration and including an engagement material that is, along with the engagement material of the support surface of the base member, capable of holding the ribbon in place between the retention surface and the support surface and transversely across the support surface for cutting without altering the appearance of the surface of the ribbon;

at least one cutting element movable beyond the retention surface and capable of being received by the receptacle of the base member after the retention surface of the top member has been positioned against the support surface of the base member.

16. The portable ribbon cutting apparatus of claim 15, further comprising:

a hinge securing an end of the base member to an end of the top member, the hinge, the base member and the top member assembled to align the top member with the base member when the retention surface of the top member is positioned against the support surface of the base member.

17. The portable ribbon cutting apparatus of claim 15, wherein the at least one cutting element of the top member comprises a wire.

18. The portable ribbon cutting apparatus of claim 17, wherein the wire is capable of being heated.

19. The portable ribbon cutting apparatus of claim 18, wherein the wire is capable of being heated only when the retention surface of the top member is positioned against the support surface of the base member.

20. The portable ribbon cutting apparatus of claim 15, further comprising:

a button associated with the top member, the button being capable of causing the cutting element to be moved beyond the retention surface of the top member and into the receptacle of the base member.

* * * * *